US007909529B2

(12) United States Patent
Gallardo

(10) Patent No.: US 7,909,529 B2
(45) Date of Patent: Mar. 22, 2011

(54) PAINTING TOOL HAVING ADJUSTABLE MASKING GUIDE

(76) Inventor: Jose Antonio Gallardo, Castaic, CA (US)

( * ) Notice: Subject to any disclaimer, the term of this patent is extended or adjusted under 35 U.S.C. 154(b) by 896 days.

(21) Appl. No.: 11/834,882

(22) Filed: Aug. 7, 2007

(65) Prior Publication Data

US 2009/0041529 A1 Feb. 12, 2009

(51) Int. Cl.
*B43K 29/00* (2006.01)

(52) U.S. Cl. ..... 401/193; 401/9

(58) Field of Classification Search ..... 401/9, 194, 401/196, 183–186, 193; 15/114, 160, 166, 15/210.1, 244.1, 246, 248.1
See application file for complete search history.

(56) References Cited

U.S. PATENT DOCUMENTS

| | | | | | |
|---|---|---|---|---|---|
| 2,784,435 | A | * | 3/1957 | Gubler | 401/193 |
| 3,341,879 | A | * | 9/1967 | Kumpman | 15/248.1 |
| 3,698,033 | A | * | 10/1972 | French | 15/246 |
| 5,331,710 | A | * | 7/1994 | Tollasepp | 15/210.1 |
| 5,933,905 | A | * | 8/1999 | Hess | 15/160 |
| 6,010,268 | A | * | 1/2000 | Sereg et al. | 401/207 |

* cited by examiner

*Primary Examiner* — David J Walczak
(74) *Attorney, Agent, or Firm* — Kelly Lowry & Kelley, LLP

(57) ABSTRACT

A hand-held paint tool has an integral adjustable masking guide adjacent to at least one edge of a painting material such that paint being applied to a surface is not simultaneously applied to adjoining or abutting surfaces. The paint mask guide is adjustable through the action of a lever or trigger connected thereto and positioned under a handle of the painting tool.

19 Claims, 8 Drawing Sheets

REPLACEMENT SHEET

6 / 8

PAINTING TOOL HAVING ADJUSTABLE MASKING GUIDE

BACKGROUND OF THE INVENTION

The present invention relates to a painting tool and more particularly to a painting tool having an adjustable paint mask guide integral therewith.

The accurate application of paint along an edge or in a straight line using a hand-held painting tool is a highly skilled task requiring experience and a far steadier hand than possessed by most people. Traditional methods for accurately painting along an edge or a straight line have involved applying a length of masking tape to define the straight line or shield the edge to remain unpainted. The tape is then removed once the paint is applied leaving a straight line or an unpainted edge. This method may be messy, costly and time consuming.

Another method involves using a brush or other paint applicator in one hand and a shield or other masking guide in another hand. As with the masking tape the shield or masking guide is held on a surface or against an edge while the paint is applied. The shield or masking guide is moved along the surface as more paint is to be applied. This method can be just as messy and time consuming as the tape masking method and requires two steady, dexterous hands.

In view of the foregoing disadvantages of traditional methods of paint masking, there is a need for an improved painting tool that is less messy, less costly and less time consuming. There is a need for a painting tool with an integral masking guide that would avoid the need of applying masking tape that would need to be removed after the paint had dried in order to paint a straight line or a clean edge. Further, there is a need for a painting tool with an integral masking guide such that a worker does not need to hold two separate implements in order to paint a straight line or a clean edge. The present invention fulfills these needs and provides other related advantages.

SUMMARY OF THE INVENTION

The present invention is directed to a hand-held painting tool with an integral adjustable paint mask. The tool comprises a base, a handle fixed to the base, a paint dispenser associated with a portion of the base an adjustable paint mask associated with the base and adjacent the paint dispenser, and a paint mask position controller associated with the handle. Bristles are oriented along the side of the tool between the paint dispenser and the adjustable paint mask.

The paint mask position controller comprises a lever or a ratcheting trigger, or preferably a cantilevered lever. The base is generally triangular and one vertex thereof has elongated bristles having a beveled edge. The handle may include a bladder which is connected to a passageway through the base to the paint dispenser. An upper portion of the handle is removable at a point of separation and replaceable with a paint tube for storing paint. The paint tube connects to the passageway through the base to deliver paint from the paint tube to the paint dispenser.

The adjustable paint mask is adjacent to two adjoining edges of the painting dispenser. The paint dispenser may comprise lambs wool, a synthetic fibrous material or other material commonly used as a paint dispenser. The adjustable paint mask preferably comprises a rigid upper portion and a pliable lower portion.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

BRIEF DESCRIPTION OF THE PREFERRED EMBODIMENTS

Figure 1:
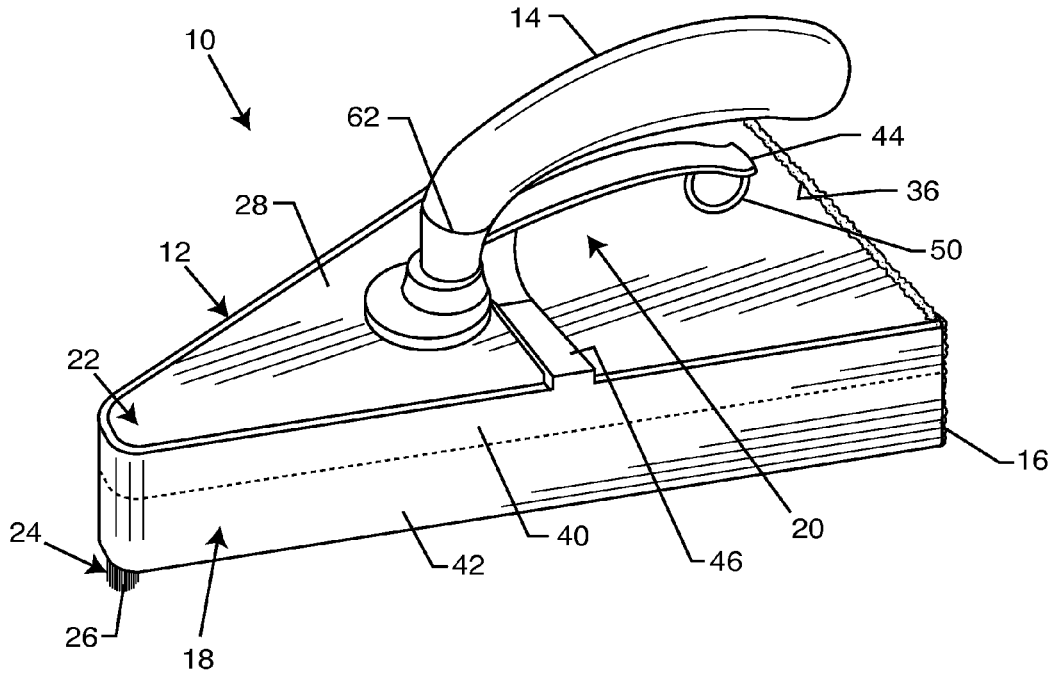
FIG. 1 is a perspective view of a preferred embodiment of the painting tool of the present invention.
Figure 2:
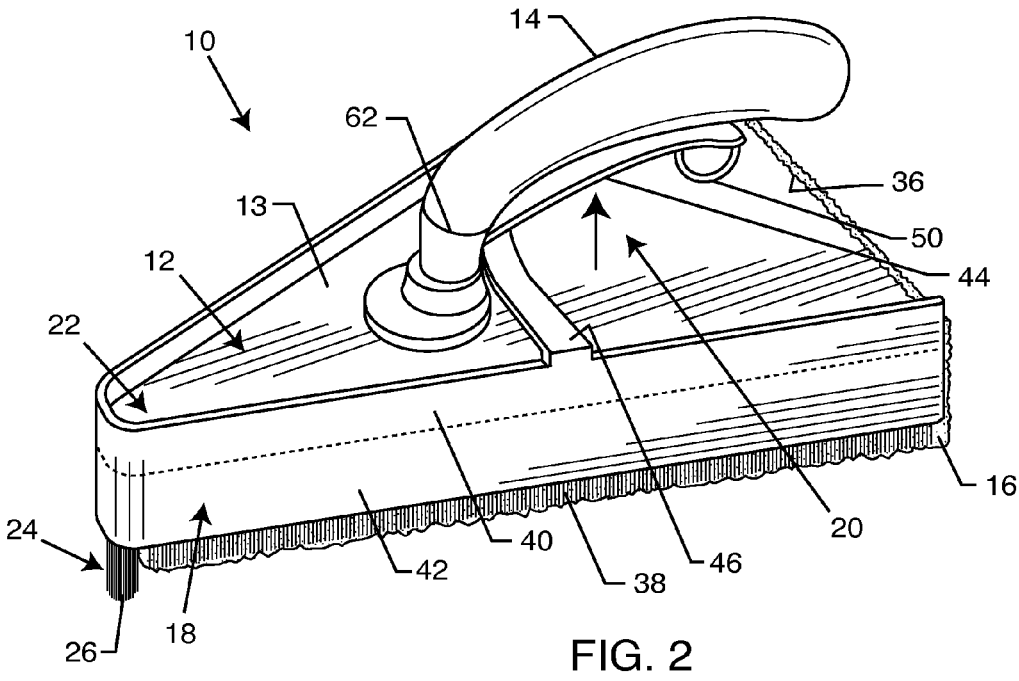
FIG. 2 is a perspective view of a preferred embodiment of the painting tool of the present invention.

As shown in the drawings for purposes of illustration, the present invention is concerned with a hand-held painting tool, generally referred to in FIGS. 1-16 by reference number 10. As shown in FIGS. 1 and 2 the painting tool 10 generally comprises a base 12, a handle 14, a paint dispenser 16, and a paint mask guide 18. In an alternate embodiment, the paint mask guide 18 may be adjustable and the tool 10 may include a paint mask position controller 20 associated with the handle 14. These elements comprise the basic features of the paint tool 10. Additional features will be described below.

The base 12 is preferably triangular in shape so as to provide three vertices 22 with a profile appropriate for reaching into corners or other recesses in order to apply paint. The base 12 may be constructed from wood, metal, plastic or any other material appropriate for forming a painting tool. One vertex 22 of the base may include extended bristles 24 with a beveled tip or beveled edge 26 as is commonly found on paint brushes. These extended bristles 24 are useful for painting in corners and recesses as described above.

Figure 10:
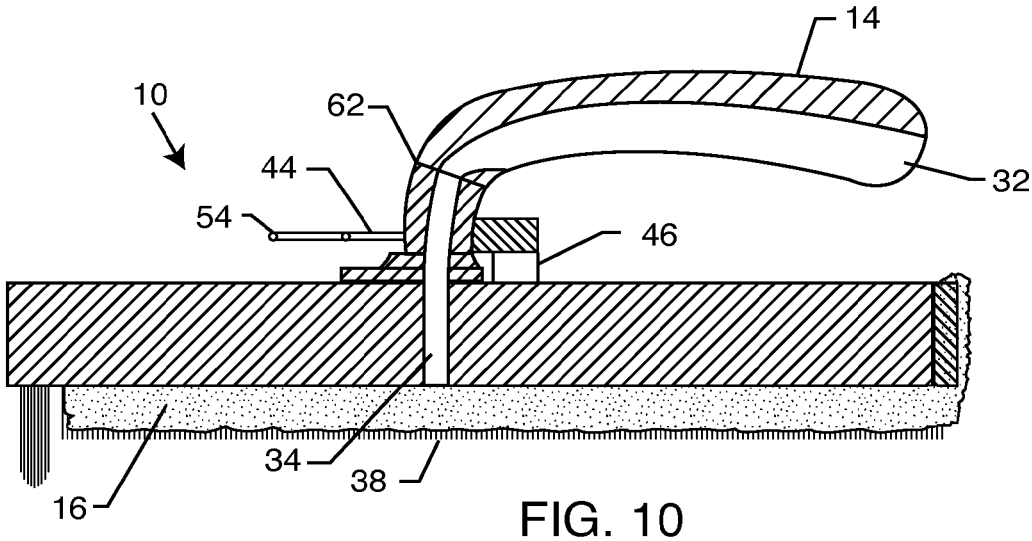
FIG. 10 is a cross-sectional view taken along line 10-10 of FIG. 9 showing the paint mask guide position controller as a cantilevered lever.

The handle 14 is preferably mounted on an upper surface 28 of the base 12 whereas the paint dispenser 16 is mounted on an opposite lower surface 30 thereof. The handle 14 is designed to present a comfortable grip and angle for the wrist and hand of a user of the paint tool 10. In alternate embodiments, as illustrated in FIG. 10, the handle may include a bladder 32. The bladder 32 is configured to connect to a passageway 34 through the base. The passageway 34 connects the bladder 32 to the paint dispenser 16. This bladder 32 can be used to draw paint from a supply (not pictured) through the paint dispenser 16 and into the bladder 32. When a full bladder 32 is squeezed, paint will be directed through the passageway 34 to the paint dispenser 16 in order to apply paint to a surface. In this way, the paint on the paint dispenser 16 can be maintained for a longer duration, requiring less trips to the supply of paint.

Figure 3:
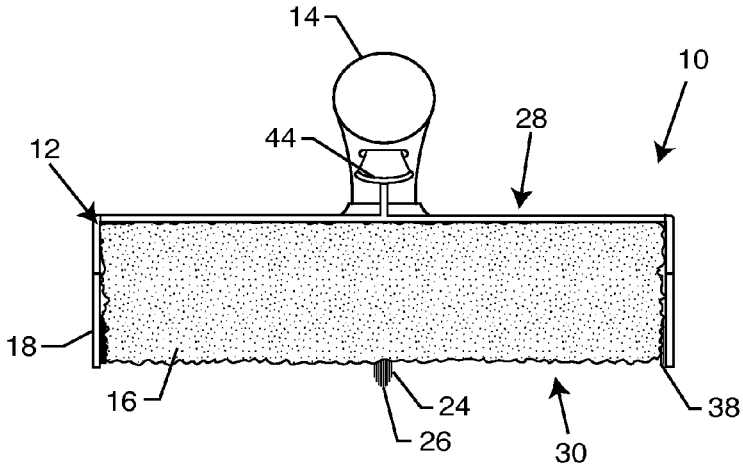
FIG. 3 is a rear view of a preferred embodiment of the painting tool of the present invention.
Figure 4:
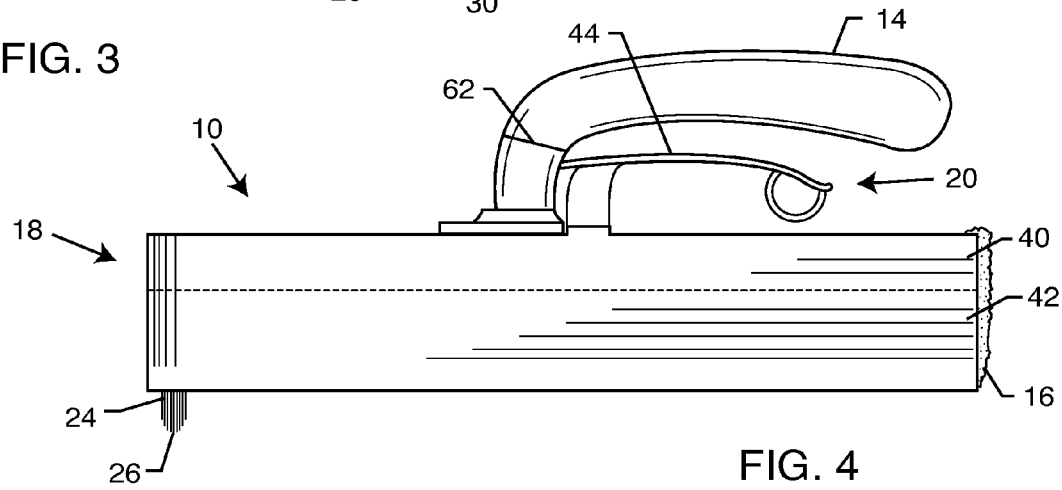
FIG. 4 is a side view of a preferred embodiment of the painting tool of the present invention.
Figure 5:
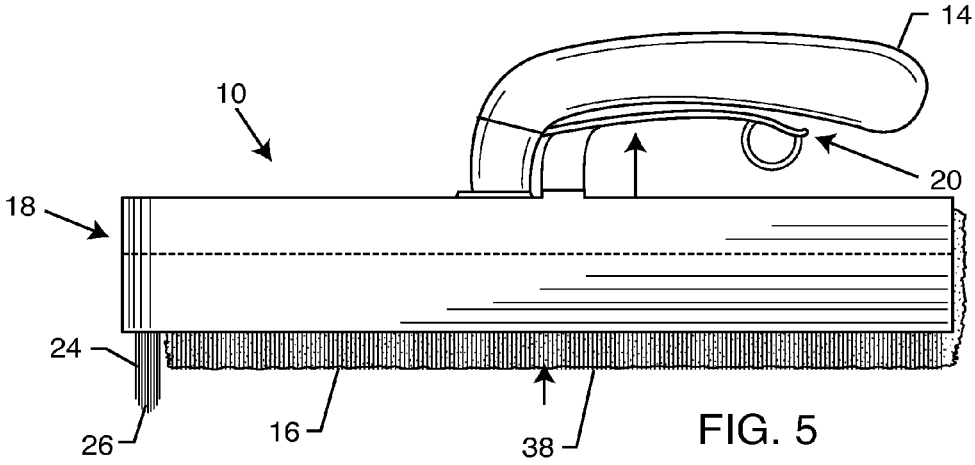
FIG. 5 is a side view of a preferred embodiment of the painting tool of the present invention.
Figure 6:
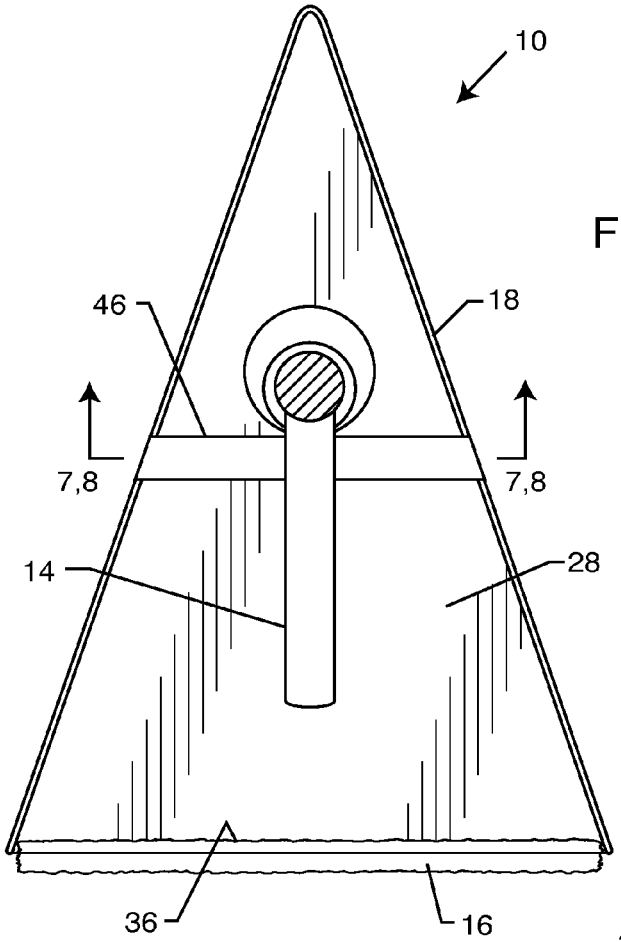
FIG. 6 is a top view of a preferred embodiment of the painting tool of the present invention.
Figure 7:
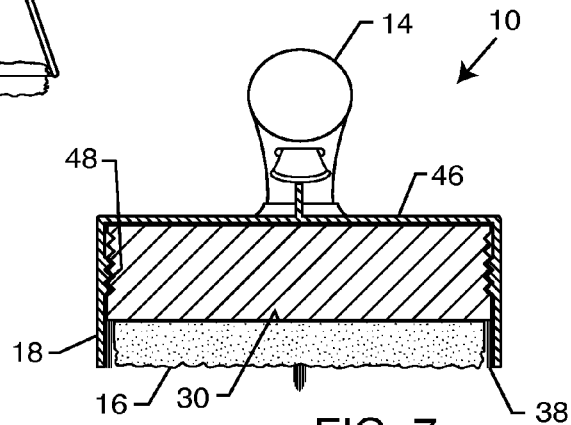
FIG. 7 is a cross-sectional view taken along line 7-7 of FIG. 6 showing the adjustable masking guide in the fully lowered position.
Figure 8:
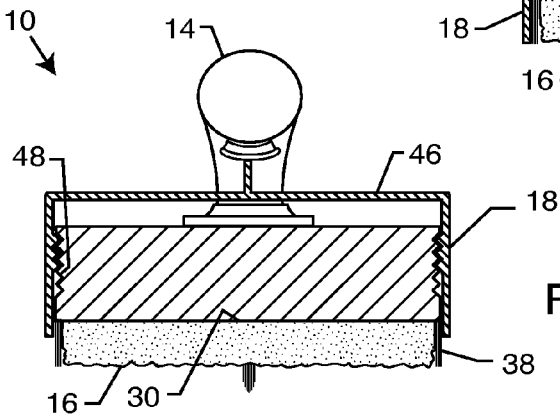
FIG. 8 is a cross-sectional view taken along line 8-8 of FIG. 6 showing the adjustable masking guide in the fully retracted position.

The paint dispenser 16 preferably comprises a lambs wool or synthetic fibrous material as is commonly found on paint rollers or similar painting devices. As described, the paint dispenser 16 is positioned on the lower surface 30 of the base 12 and preferably wraps around a back side 36 of the base 12 and ends near the upper surface 28 as illustrated in FIGS. 3, 4 and 5. The paint dispenser 16 on the lower surface 30 is adjacent an opening of the passageway 34 described above. Side bristles 38 are positioned along two sides of the paint dispenser 16. These bristles 38 assist in the application of paint to a surface. When paint is applied from the side bristles 38 it tends to be more uniformly straight than when applied from the paint dispenser 16 alone.

The paint mask guide 18 is positioned along at least one side of the base 12 adjacent the paint dispenser. Preferably, the paint mask guide 18 is adjacent two sides of the base 12—the same two sides on which the side bristles 38 are located. The side bristles 38 are located between the paint dispenser 16 and the paint mask guide 18. In this configuration, the paint mask guide 18 may be affixed to the side of the base 12 so as to be co-extensive with the paint dispenser 16 and the side bristles 18. In the alternate embodiment, the paint mask guide 18 is adjustable as described below.

The paint mask guide 18 is preferably made from plastic or rubber, but metal or other materials commonly found in painting products may also be used. Plastic is preferred so as to be less likely to scratch or otherwise damage a surface to be covered by the guide. While the paint mask guide 18 may be uniformly made of these materials, in the adjustable embodiment, the paint mask guide 18 may have an upper portion 40 made from a rigid material and a lower portion 42 made from a pliable or flexible material. The rigid upper portion 40 makes the paint mask guide 18 more stable when it is raised and lowered as described below. The flexible lower portion 42 allows the paint mask guide 18 to move and bend in response to contact with certain edges. This action of the flexible lower portion 42 allows for painting lines to approach more closely to wood trim, cover plates, and other features on surfaces a user may be painting.

When in a fully lowered position, the paint mask guide 18 fully covers the side of the paint dispenser 16 and side bristles 38 as illustrated in FIGS. 1, 3, 4, and 7. When fully raised in the direction of the arrows in FIGS. 2 and 5, the paint dispenser 16 and bristles 38 are fully exposed and not covered by the paint mask guide 18.

The position of the paint mask guide 18 is regulated by a paint mask guide position controller 20. The position controller 20 comprises a lever or trigger 44 adjacent to the handle 14. The lever/trigger 44 is connected to a pair of guide arms 46, which move outward from the handle 14 toward the side edges of the base 12. These guide arms 46 are attached to the rigid upper portion 40 of the paint mask guide 18. Through the action of the lever/trigger 44, the guide arms 46 operate to raise and lower the paint mask guide 18. Ratcheting teeth 48, located between the paint mask guide 18 and the side of the base 12, engage to hold the paint mask guide 18 in a locked position. The ratcheting teeth 48 are aligned perfectly parallel to the plane of the tool 10 so that the teeth 48 are able to raise and lower with respect to one another when the lever/trigger 44 is actuated. The locked position of the ratcheting teeth 48 corresponds to whatever position the paint mask guide 18 is in when a user releases the lever/trigger 44.

The lever/trigger 44 may operate in any number of ways designed to achieve the desired raising and lowering of the paint mask guide 18. In one preferred embodiment, as illustrated in FIGS. 1-8, the trigger 44 is positioned beneath the handle 14. A user grasping the tool 10 would grasp the handle 14 and wrap his or her finger around the trigger 44. The user may place a finger, preferably the little finger, into a ring 50 positioned near the end of the trigger 44. To raise the paint mask guide 18, a user squeezes his or her fingers to draw the trigger 44 closer to the handle 14, thereby raising the guide arms 46 and the paint mask guide 18. The ratcheting teeth 48 lock engage and the paint mask guide 18 in a set position when the user stops squeezing the trigger 44. To lower the paint mask guide 18, a user pushes the trigger 44 away from the handle 14 by using the ring 50, thereby lowering the guide arms 46 and the paint mask guide 18.

Figure 9:
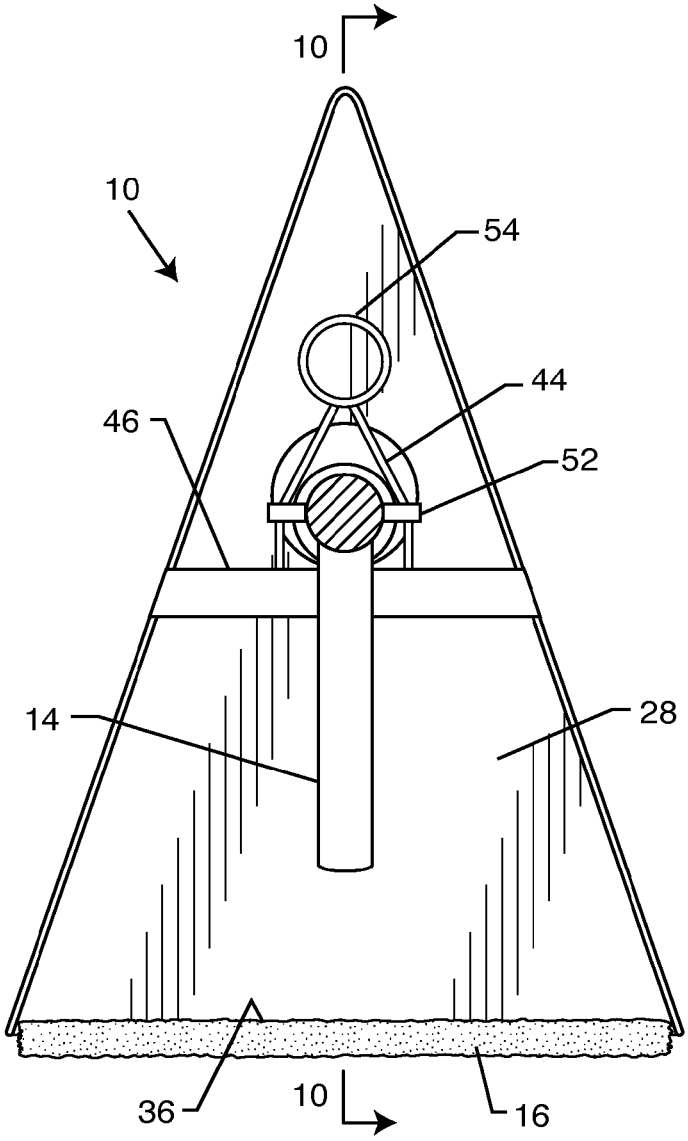
FIG. 9 is a top view of a preferred embodiment of the painting tool of the present invention.
Figure 16:
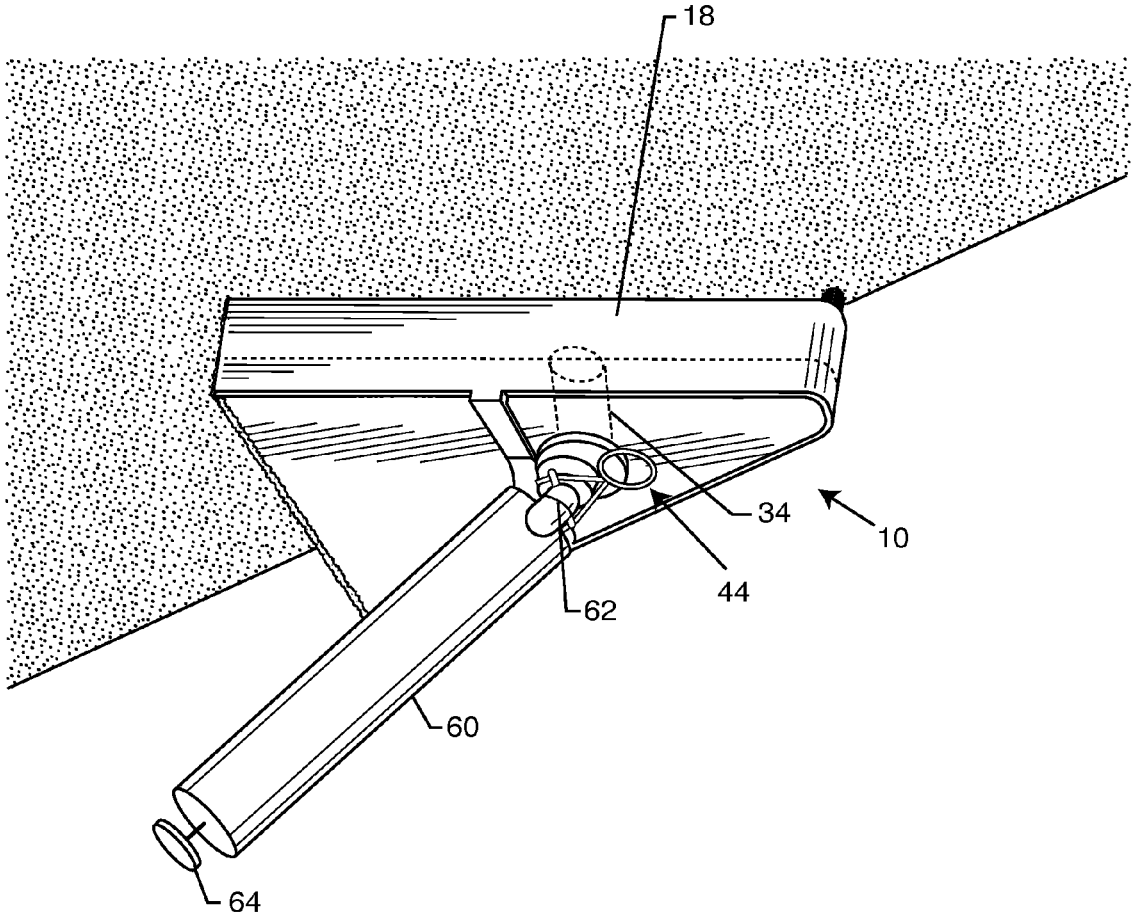
FIG. 16 is an illustration of the painting tool of the present invention including a paint tube for the handle.

In another preferred embodiment, as illustrated in FIGS. 9, 10 and 16, the cantilevered lever 44 extends from the guide arms 46 toward the front of the tool 10 around the handle 14. The lever 44 pivots about a fulcrum 52 located on the sides of the handle 14. A ring 54 for the user's index finger is positioned on the lever 44 near the front of the tool 10. In this embodiment when a user pushes the ring 54 down, the lever 44 turns about the fulcrum 52 and the guide arms 46 are raised, thereby raising the paint mask guide 18. When a user pulls the ring 54 up, the lever 44 turns about the fulcrum 52 in the opposite direction and the guide arms 46 are lowered, thereby lowering the paint mask guide 18. The ratcheting teeth 48 operate as described above.

Figure 11:
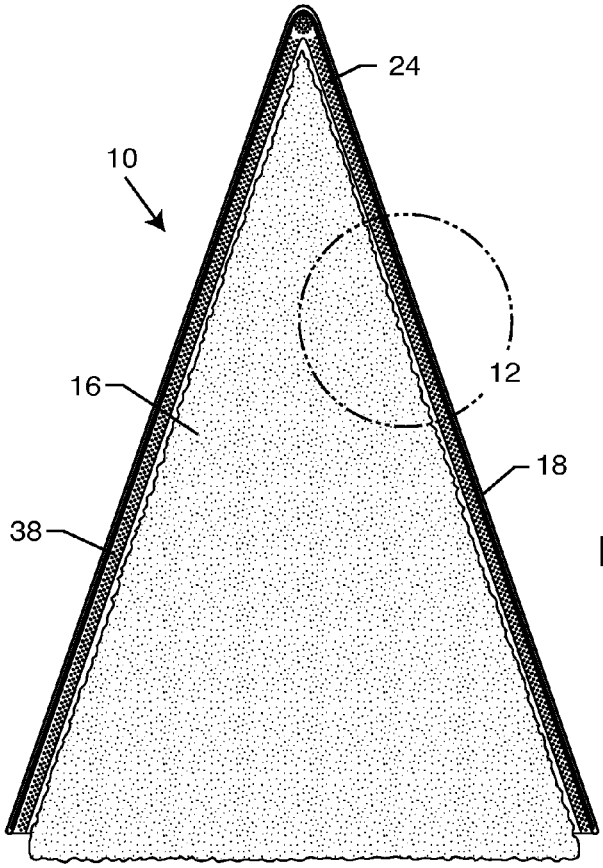
FIG. 11 is a bottom view of a preferred embodiment of the painting tool of the present invention.
Figure 12:
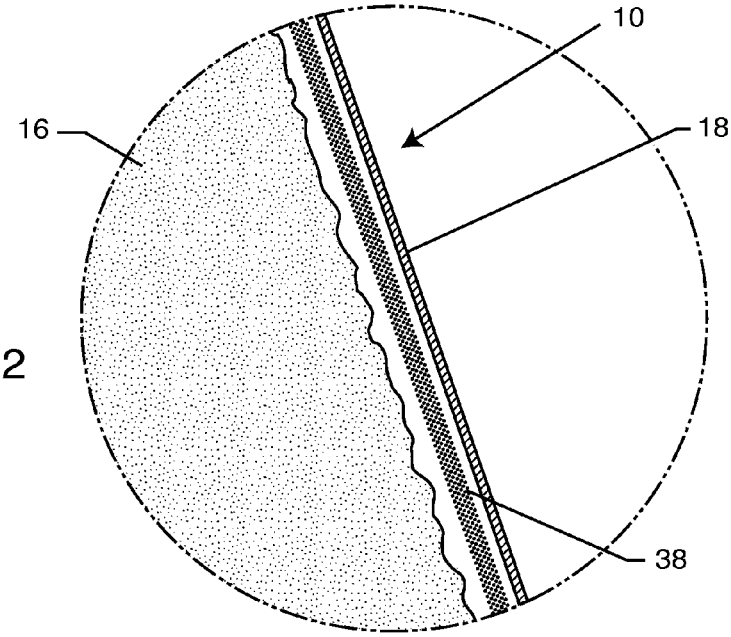
FIG. 12 is a close-up view of a portion of FIG. 11 indicated by circle 12.

FIGS. 1, 2, 4, 5, 7 and 8 illustrate the raising and lowering of the paint mask guide 18 as described above. Note how the paint mask guide 18 fully masks the profile of the paint dispenser 16 and side bristles 38 on the lower surface 30 of the paint tool 10. As shown by the arrows in FIGS. 2, 5 and 8, when the guide arms 46 are moved toward the handle 14 the paint mask guide 18 is raised to a retracted position. Note how the paint dispenser 16 and side bristles 38 are visible below the paint mask guide 18 when it is raised. FIGS. 11 and 12 illustrate the relative positions of the paint dispenser 16, the side bristles 38 and the paint mask guide 18 when viewing the tool 10 from the underside.

In operation, a user would raise the paint mask guide 18 while applying paint to the paint dispenser 16. Used in this way, the paint mask guide 18 remains free of paint while paint is applied to the paint dispenser 16. The paint may be applied simply by placing the paint dispenser 16 into a supply of paint in order to coat the paint dispenser 16. Alternatively, as described above, the bladder 32 may be used to draw more paint into the tool 10.

Figure 13:
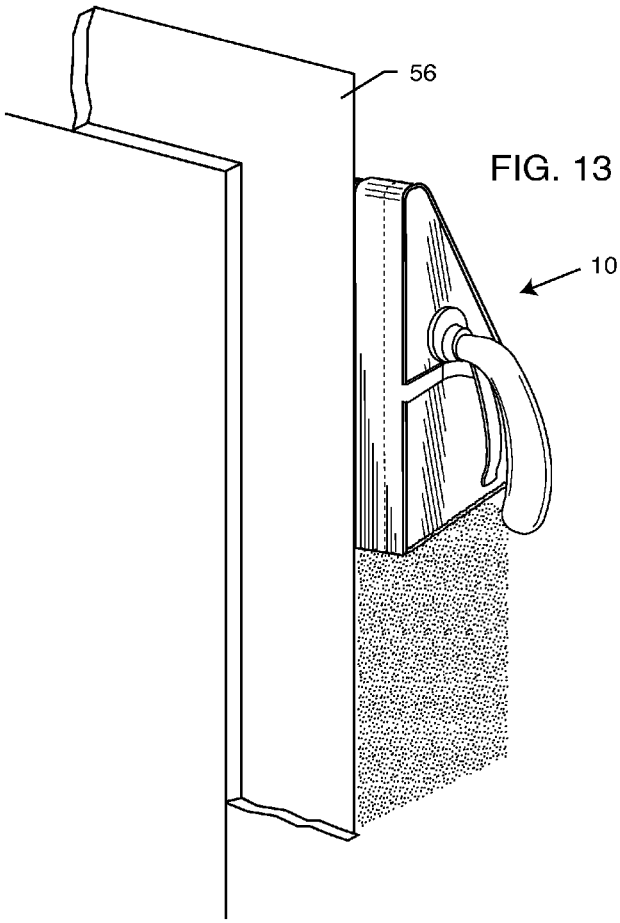
FIG. 13 is an illustration of the use of a painting tool of the present invention painting around the trim of a doorjamb.
Figure 14:
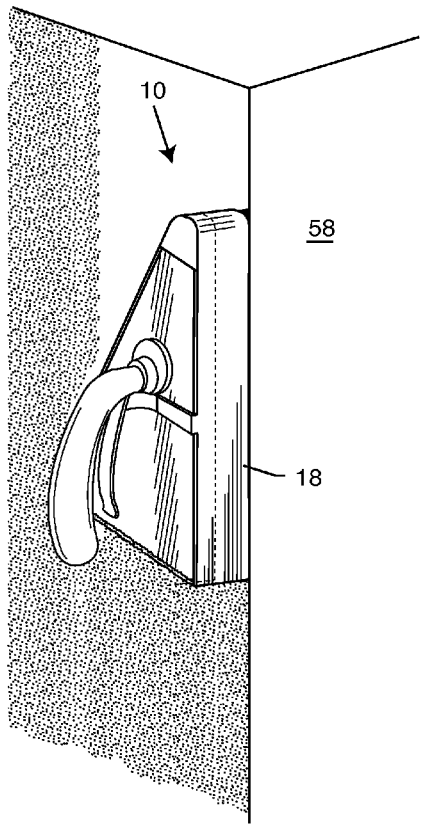
FIG. 14 is an illustration of the painting tool of the present invention painting in a corner edge.

As illustrated in FIGS. 13 and 14, while painting along the edge of wood trim or in a corner, a user would have the paint mask guide 18 in a fully lowered position. When the paint tool 10 is used against wood trim (FIG. 15) or in a corner (FIG. 16) the paint mask guide 18 prevents the application of paint on the side of the wood trim 56 or the adjoining wall 58 in the corner. Using this paint tool 10 a user can paint straight, clean lines along wood trim or corners without the need to apply masking tape or use a separate paint masking tool.

Figure 15:
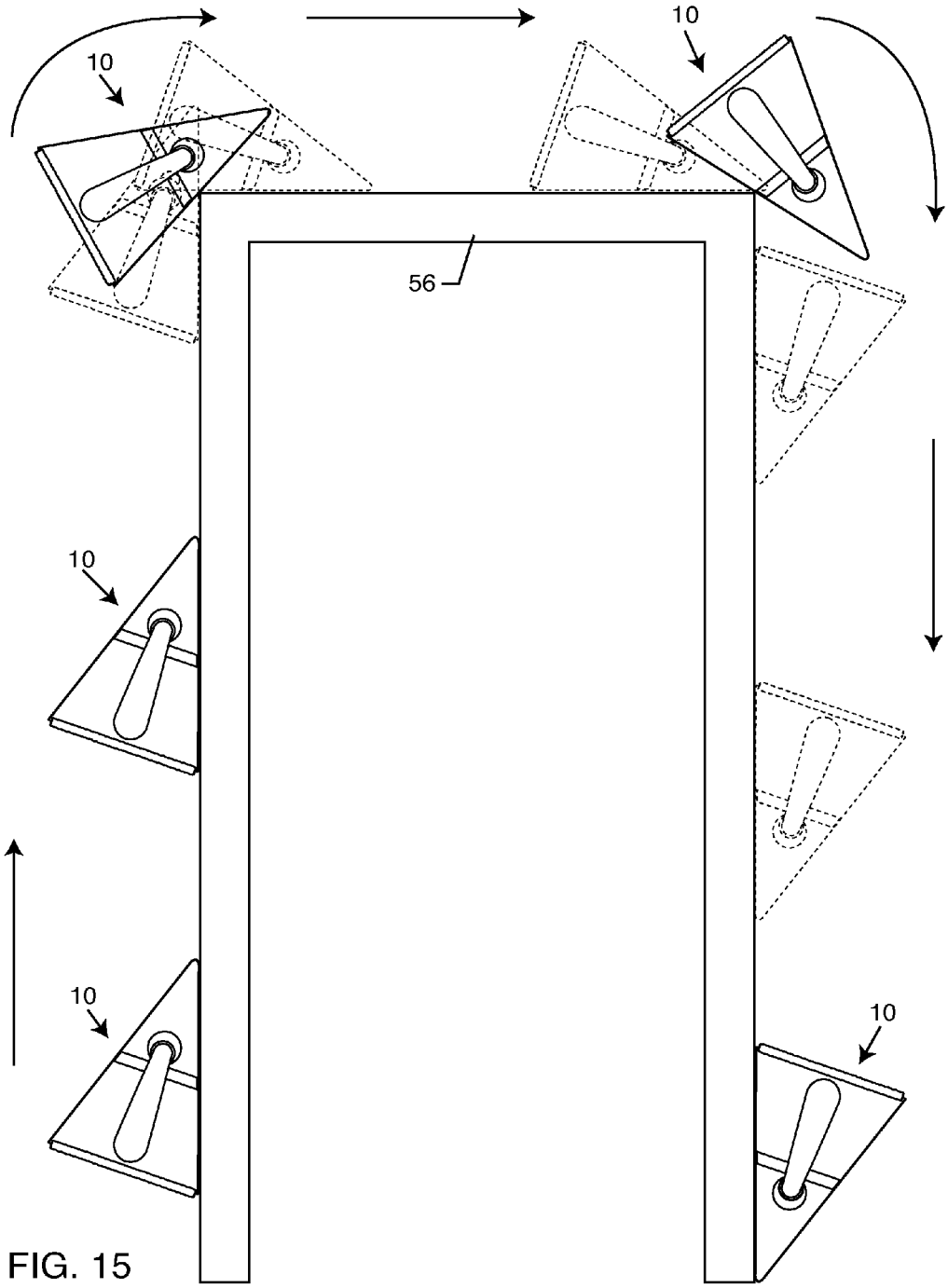
FIG. 15 is an illustration of the painting tool of the present invention painting around the edge of a doorjamb.

In addition, because of the triangular design of the base, a person can paint around the entirety of the wood trim 56 on a door as illustrated in FIG. 15. As shown, this task can be accomplished in a single motion while moving the paint tool 10 around the perimeter of the wood trim 56 on the doorway. One will realize that this tool 10 will allow a painting job such as this or other similar tasks to be completed with relative ease and speed.

FIG. 16 illustrates an alternate embodiment of the paint tool 10 of the present invention including a paint tube 60 in place of the handle 14. The handle 14 may be designed to allow the handle 14 to separate from the base 12. At this point of separation 62, a paint tube 60 may be attached to hold a supply of paint therein. Note that this point of separation 62 is located above the lever/trigger 44 described above. This configuration allows the adjustable feature of the paint mask guide 18 to be available on the tool 10 while using either the handle 14 or the paint tube 16.

A plunger 64 or other similar construction, i.e., a ratcheting mechanism similar to a caulking gun, is designed to force the paint through the tube 60 and onto the passageway 34 through the base 12. As described above, the passageway 34 introduces paint to the paint dispenser 16. As illustrated in FIG. 16 the paint tube 60 allows a user to use this paint tool 10 on a ceiling while still forcing paint to the paint dispenser 16. As with the other embodiments, the paint mask guide 18 operates to protect the adjoining wall 58 from the paint released from the paint dispenser 16.

Although several embodiments have been described in detail for purposes of illustration, various modifications may be made without departing from the scope and spirit of the invention. Accordingly, the invention is not to be limited, except as by the appended claims.

What is claimed is:

1. A painting tool, comprising:
- a base;
- a handle fixed to the base;
- a paint dispenser associated with a portion of the base;
- a paint mask associated with the base and adjacent the paint dispenser; and
- a paint mask position controller associated with the handle comprising a lever or a ratcheting trigger, wherein the position of the paint mask is adjustable with respect to the paint dispenser;
- wherein the base is generally triangular and one vertex thereof has elongated bristles having a beveled edge.

2. The painting tool of claim 1, further comprising bristles between the paint dispenser and the paint mask.

3. The painting tool of claim 1, wherein the paint mask position controller comprises a cantilevered lever.

4. The painting tool of claim 1, wherein the handle includes a bladder which is connected to a passageway through the base to the paint dispenser.

5. The painting tool of claim 4, wherein an upper portion of the handle is removable and replaceable with a paint tube for storing paint and said paint tube connects to the passageway through the base to deliver paint from the paint tube to the paint dispenser.

6. The painting tool of claim 1, wherein the adjustable paint mask is adjacent to two adjoining edges of the painting dispenser.

7. The painting tool of claim 1, wherein the paint dispenser comprises lambs wool or a synthetic fibrous material.

8. The painting tool of claim 1, wherein the adjustable paint mask comprises a rigid upper portion and a pliable lower portion.

9. A painting tool, comprising:
- a base having a passageway therethrough;
- a handle fixed to the base, the handle including a bladder which is connected the passageway through the base;
- a paint dispenser associated with a portion of the base and adjacent the passageway through the base;
- an adjustable paint mask associated with the base and adjacent to two adjoining edges of the paint dispenser; and
- a paint mask position controller associated with the handle;
- wherein the base is generally triangular and one vertex thereof has elongated bristles having a beveled edge.

10. The painting tool of claim 9, further comprising bristles between the paint dispenser and the adjustable paint mask.

11. The painting tool of claim 9, wherein the paint mask position controller comprises a lever or a ratcheting trigger.

12. The painting tool of claim 11, wherein the paint mask position controller comprises a cantilevered lever.

13. The painting tool of claim 9, wherein an upper portion of the handle is removable and replaceable with a paint tube for storing paint and said paint tube connects to the passageway through the base to deliver paint from the paint tube to the paint dispenser.

14. The painting tool of claim 9, wherein the paint dispenser comprises lambs wool or a synthetic fibrous material.

15. The painting tool of claim 9, wherein the adjustable paint mask comprises a rigid upper portion and a pliable lower portion.

16. A painting tool, comprising:
- a generally triangular base having a passageway therethrough, wherein one vertex thereof has elongated bristles having a beveled edge;
- a handle fixed to the base, the handle including a bladder which is connected the passageway through the base;
- a paint dispenser associated with a portion of the base and adjacent the passageway through the base;
- an adjustable paint mask associated with the base and adjacent to two adjoining edges of the paint dispenser;
- a paint mask position controller comprising a cantilevered lever associated with the handle.

17. The painting tool of claim 16, further comprising bristles between the paint dispenser and the adjustable paint mask.

18. The painting tool of claim 16, wherein an upper portion of the handle is removable and replaceable with a paint tube for storing paint and said paint tube connects to the passageway through the base to deliver paint from the paint tube to the paint dispenser.

19. The painting tool of dam 16, wherein the paint dispenser comprises lambs wool or a synthetic fibrous material and the adjustable paint mask comprises a rigid upper portion and a pliable lower portion.

* * * * *